US009077128B2

(12) United States Patent
Choi et al.

(10) Patent No.: US 9,077,128 B2
(45) Date of Patent: Jul. 7, 2015

(54) MULTI-TYPE RECEPTACLE CONNECTOR AND PLUG CONNECTOR APPLIED THERETO

(71) Applicant: LS Mtron Ltd., Anyang-si (KR)

(72) Inventors: Jung-Hoon Choi, Seoul (KR); Kyung-Hae Choi, Suwon-Si (KR); Dong-Hee Kim, Suwon (KR)

(73) Assignee: LS MTRON LTD., Anyang-Si (KR)

( * ) Notice: Subject to any disclaimer, the term of this patent is extended or adjusted under 35 U.S.C. 154(b) by 30 days.

(21) Appl. No.: 13/943,216

(22) Filed: Jul. 16, 2013

(65) Prior Publication Data

US 2015/0024616 A1 Jan. 22, 2015

(51) Int. Cl.
*H01R 27/00* (2006.01)
*H01R 13/64* (2006.01)

(52) U.S. Cl.
CPC ..... *H01R 27/00* (2013.01); *H01R 13/64* (2013.01)

(58) Field of Classification Search
USPC ..... 439/135, 660, 638, 108, 607.01; 711/103
See application file for complete search history.

(56) References Cited

U.S. PATENT DOCUMENTS

| | | | | |
|---|---|---|---|---|
| 7,318,752 | B2 * | 1/2008 | Fujimoto et al. | 439/660 |
| 7,722,407 | B2 * | 5/2010 | Momose | 439/638 |
| 7,815,469 | B1 * | 10/2010 | Nguyen et al. | 439/607.35 |
| 8,198,563 | B2 * | 6/2012 | Tsai | 218/140 |
| 8,301,831 | B2 * | 10/2012 | Ni et al. | 711/103 |
| 8,444,423 | B2 * | 5/2013 | Nguyen et al. | 439/76.1 |
| 8,690,608 | B2 * | 4/2014 | Naito et al. | 439/660 |
| 2005/0059301 | A1 * | 3/2005 | Chou et al. | 439/660 |
| 2007/0049119 | A1 * | 3/2007 | Fujimoto et al. | 439/610 |
| 2008/0261448 | A1 * | 10/2008 | Yi et al. | 439/607 |
| 2009/0227147 | A1 * | 9/2009 | Momose | 439/638 |
| 2013/0115822 | A1 | 5/2013 | Pan et al. | |
| 2013/0149915 | A1 * | 6/2013 | Kim et al. | 439/692 |
| 2013/0164993 | A1 * | 6/2013 | Wang et al. | 439/676 |

FOREIGN PATENT DOCUMENTS

| | | | |
|---|---|---|---|
| EP | 2 453 275 | A1 | 5/2012 |
| JP | 10-032046 | A | 2/1998 |
| JP | 11-307200 | A | 11/1999 |
| JP | 2009-0212009 | A | 9/2009 |
| JP | 2011-159587 | A | 8/2011 |
| KR | 10-2013-0059111 | A | 6/2013 |
| KR | 10-2013-0059112 | A | 6/2013 |
| WO | 2013/071512 | A1 | 5/2013 |

OTHER PUBLICATIONS

"Universal Serial Bus Cables and Connectors Class Document", Retrieved from the Internet: URL:http://www.usb.org/developers/devclassdocs/CabConn20.pdf [retrieved on Nov. 7, 2013] *p. 40-p. 46*, Aug. 2007.

* cited by examiner

*Primary Examiner* — Alexander Gilman
(74) *Attorney, Agent, or Firm* — LRK Patent Law Firm

(57) ABSTRACT

A multi-type receptacle connector includes a receptacle insulator, main receptacle contacts arranged at the receptacle insulator to provide an electric contact point corresponding to a universal plug connector, sub receptacle contacts additionally installed at both sides of the main receptacle contacts to give an additional contact point, and a receptacle shell surrounding at least a part of the receptacle insulator, wherein the sub receptacle contacts are arranged at the same height as the main receptacle contacts and disposed at a relatively inner side in the insertion direction of a plug connector in comparison to the main receptacle contacts.

12 Claims, 5 Drawing Sheets

MULTI-TYPE RECEPTACLE CONNECTOR AND PLUG CONNECTOR APPLIED THERETO

BACKGROUND OF THE DISCLOSURE

1. Field of the Disclosure

The present disclosure relates to a connector, and more particularly, to a multi-type receptacle connector having a sub contact in addition to a main contact to provide an additional connection module, and a plug connector applied thereto.

2. Description of the Related Art

Recently, the use of portable electronic devices such as cellular phones, notebooks, PMP, portable game players, MP3 players and smart phones, are gradually increasing in terms of kinds and functions. In particular, portable electronic devices have a connector unit for data communication. The connector unit includes a receptacle connector mounted on a printed circuit board (PCB) in the portable electronic device and a plug connector coupled thereto and is used for data communication or connected to a power device for supply of power.

Lately, as the connector unit, a micro USB is widely used. The micro USB includes five contacts, an insulator for mounting the contacts by insert molding, and a shell surrounding the insulator.

However, since the micro USB is configured only in a five-pin type having five contacts, this may be limited to only being used for connecting a connector designed according to USB standards. Accordingly, in order to connect an additional connection module to a small-size portable electronic device, an additional connector should be prepared separately.

SUMMARY OF THE DISCLOSURE

The present disclosure is designed to solve the problems of the prior art, and therefore it is an object of the present disclosure to provide a multi-type receptacle connector which may provide an additional connection module by including a sub contact in addition to a main contact and may also prevent an inferior connection while ensuring compatibility with an existing plug connector, and a plug connector applied thereto.

In one aspect of the present disclosure, there is provided a multi-type receptacle connector, which includes a receptacle insulator; main receptacle contacts arranged at the receptacle insulator to provide an electric contact point corresponding to a universal plug connector; sub receptacle contacts additionally installed at both sides of the main receptacle contacts to give an additional contact point; and a receptacle shell surrounding at least a part of the receptacle insulator, wherein the sub receptacle contacts are arranged at the same height as the main receptacle contacts and disposed at a relatively inner side in the insertion direction of a plug connector in comparison to the main receptacle contacts.

Preferably, the sub receptacle contacts may have a relatively shorter length in comparison to the main receptacle contacts.

Preferably, the sub receptacle contacts may include at least one contact at each of both sides of the main receptacle contacts, and the contacts disposed at both sides may be arranged with the same number or different numbers.

Preferably, the receptacle shell may include a first stopper for preventing a universal plug connector having only contact points with the main receptacle contacts from being excessively inserted; and a second stopper for preventing a multi plug connector having contact points with the main receptacle contacts and sub receptacle contacts from being excessively inserted.

Preferably, the first stopper may be located at a relatively front side in the inserting direction of the plug connector in comparison to the second stopper, and the multi plug connector may have an escaping structure for escaping from the second stopper.

Preferably, the receptacle shell may include a first locking member for fixing the coupled universal plug connector; and a second locking member for fixing the coupled multi plug connector.

Preferably, the second locking member may include an elastic piece protruding inwards at an upper portion of the receptacle shell, and a hole structure corresponding to the elastic piece may be provided at an upper portion of the multi plug connector.

Preferably, the main receptacle contacts and the sub receptacle contacts may be accommodated in the receptacle insulator in an insertion-molding fashion.

Preferably, the universal plug connector may be a micro USB plug connector.

In another aspect of the present disclosure, there is also provided a multi-type plug connector, which includes main plug contacts and sub plug contacts respectively corresponding to the main receptacle contacts and the sub receptacle contact of the multi-type receptacle connector as described above; a plug insulator for accommodating the main plug contacts and the sub plug contacts; and a plug shell surrounding at least a part of the plug insulator, wherein the sub plug contacts are arranged at the same height as the main plug contacts and disposed to protrude relatively forwards in comparison to the main plug contacts.

Preferably, the sub plug contacts may have a relatively longer length in comparison to the main plug contacts.

Preferably, the sub plug contacts may include at least one contact at each of both sides of the main plug contacts, and the contacts disposed at both sides may be arranged with the same number or different numbers.

Preferably, the plug shell may have a locking hole to be coupled and fixed to the multi-type receptacle connector, and the multi-type receptacle connector may have an elastic piece protruding inwards corresponding to the locking hole.

According to the present disclosure, since the receptacle connector may include a sub contact in addition to a main contact, the space of the connector may be efficiently used. In addition, it is possible to prevent an inferior connection while ensuring compatibility with an existing plug connector. Accordingly, the connector of the present disclosure may be simultaneously used as an interface connector of a portable electronic device such as a cellular phone to serve as a micro USB port and a predetermined additional connection module.

BRIEF DESCRIPTION OF THE DRAWINGS

The accompanying drawings illustrate preferred embodiments of the present disclosure and, together with the foregoing disclosure, serve to provide further understanding of the technical spirit of the present disclosure. However, the present disclosure is not to be construed as being limited to the drawings in which.

| Reference Symbols |
|---|
| 100: receptacle connector |
| 110: receptacle contact |
| 111: main receptacle contact |
| 112a, 111b: sub receptacle contact |
| 120: receptacle insulator |
| 130: receptacle shell |
| 200: plug connector |
| 210: plug contact |
| 211: main plug contact |
| 212a, 212b: sub plug contact |
| 220: plug insulator |
| 230: plug shell |

DESCRIPTION OF THE PREFERRED EMBODIMENT

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the spirit and scope of the disclosure.

Figure 1:
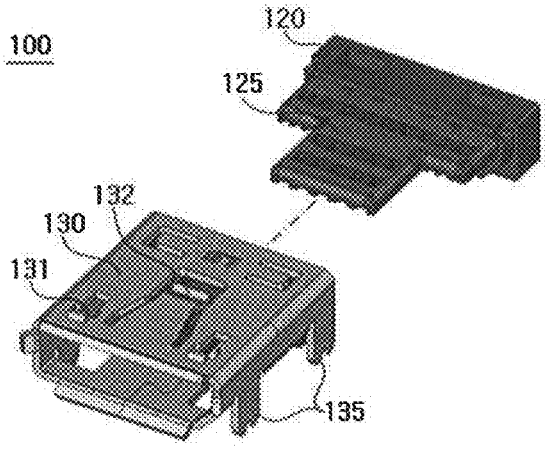
FIG. 1 is an exploded perspective view showing a multi-type receptacle connector according to the present disclosure.
Figure 2:
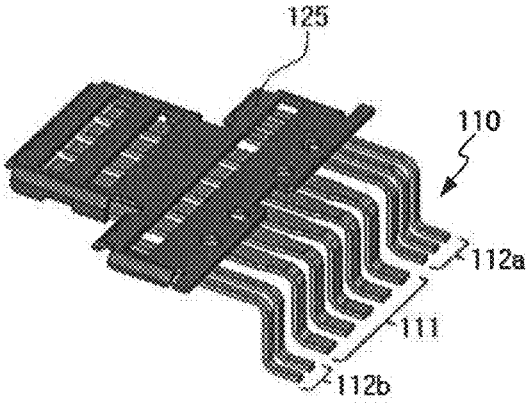
FIG. 2 is a perspective view showing a contact before being insert-molded to the insulator of FIG. 1.
Figure 3:
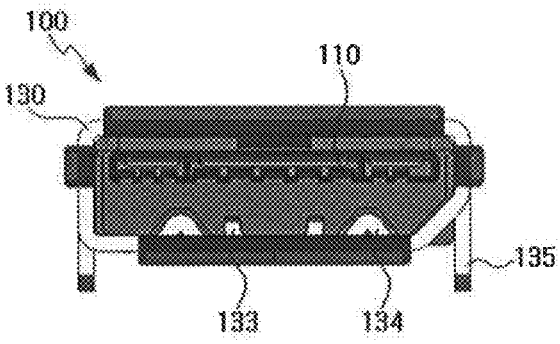
FIG. 3 is a front view showing the multi-type receptacle connector according to the present disclosure.
Figure 4:
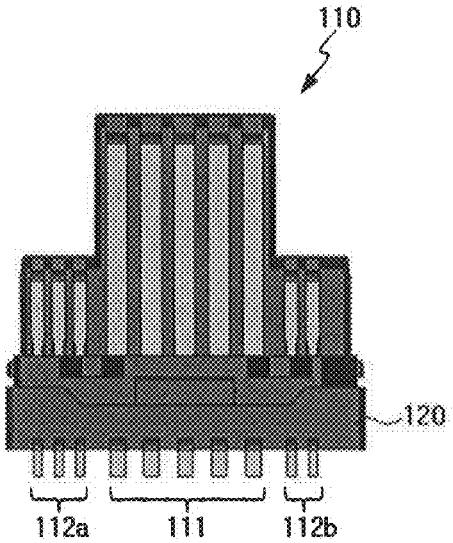
FIG. 4 is a plane view showing an arrangement of contacts in the multi-type receptacle connector according to the present disclosure.

FIG. 1 is an exploded perspective view showing a multi-type receptacle connector according to the present disclosure, FIG. 2 is a perspective view showing a contact before being insert-molded to the insulator of FIG. 1, FIG. 3 is a front view showing the multi-type receptacle connector according to the present disclosure, and FIG. 4 is a plane view showing an arrangement of contacts in the multi-type receptacle connector according to the present disclosure.

Referring to FIGS. 1 to 4, a multi-type receptacle connector 100 according to the present disclosure includes a receptacle insulator 120 having a plurality of contacts 110 arranged therein and a receptacle shell 130 for surrounding and shielding at least a part of the receptacle insulator 120.

The plurality of contacts 110 is accommodated in the receptacle insulator 120 by means of insert molding. At this time, in order to fix the arrangement of the plurality of contacts 110 and reinforce the strength thereof, a support plate 125 may be further provided. In this case, the plurality of contacts 110 and the support plate 125 are inserted into and fixed in a mold for insert molding, and then a plastic resin is injected into the mold for insert molding to form the receptacle insulator 120 in which the plurality of contacts 110 are molded.

The plurality of contacts 110 includes main receptacle contacts 111 arranged with regular pitches and sub receptacle contacts 112*a*, 112*b* arranged at both sides of the main receptacle contacts 111, as shown in FIG. 2.

The main receptacle contacts 111 are arranged at the receptacle insulator 120 and give an electric contact point corresponding to a universal plug connector (for example, a micro USB). For example, as shown in FIG. 4, five-pin contacts may be arranged with regular pitches to satisfy pin standards of the micro USB.

The sub receptacle contacts 112*a*, 112*b* are additionally installed at both sides of the main receptacle contacts 111 and gives an additional contact point. The sub receptacle contacts 112*a*, 112*b* are used when an additional connection module is to be connected separately from the main receptacle contacts 111. The sub receptacle contacts 112*a*, 112*b* are arranged to have a contact point at the same height as the main receptacle contacts 111 and disposed relatively inwards in the inserting direction of a plug connector in comparison to the main receptacle contacts 111. In other words, the sub receptacle contacts 112*a*, 112*b* have a relatively shorter length in comparison to the main receptacle contacts 111. In addition, the sub receptacle contacts 112*a*, 112*b* may have at least one contact at each of both sides of the main receptacle contacts 111 in order to occupy a space of the receptacle insulator 120 which remains after the main receptacle contacts 111 are disposed. At this time, the sub receptacle contacts 112*a*, 112*b* may be arranged at both sides with the same number or different numbers. For example, as shown in FIG. 4, the sub receptacle contacts 112*a*, 112*b* may include three-pin contacts 112*a* at the left side and two-pin contacts 112*b* at the right side, which are arranged with regular pitches, based on the center of the main receptacle contacts 111. However, the present disclosure is not limited thereto, and various modifications can be made, as obvious to those skilled in the art.

The receptacle shell 130 plays a role of surrounding and shielding a part of the receptacle insulator 120. In addition, the receptacle shell 130 plays a role of helping coupling with a plug connector 200 corresponding to the receptacle connector 100.

The receptacle shell 130 includes a first locking member 131 for fixing a general coupled universal plug connector and a second locking member 132 for fixing a coupled multi-type plug connector 200, at an upper portion thereof.

The first locking member 131 has a locking structure applied to a general universal receptacle connector and a plug connector and has a hole structure corresponding to a latch of the universal plug connector.

The second locking member 132 has an elastic piece protruding inwards at the upper portion of the receptacle shell 130 in order to fix the coupled multi-type plug connector 200. The multi-type plug connector 200 has a hole structure corresponding to the second locking member 132, and the plug connector 200 inserted into the receptacle connector 100 is fixed by means of coupling between them. Since the multi-type receptacle connector 100 has a longer length than an existing universal receptacle connector and the multi-type plug connector 200 corresponding thereto also has a longer length, a locking position may be located inwards so that the receptacle connector and the plug connector are coupled and fixed more stably.

As shown in FIG. 3, the receptacle shell 130 includes a first stopper 133 for preventing a general universal plug connector from being excessively inserted at the lower portion thereof and a second stopper 134 for preventing the multi-type plug connector 200, described later, from being excessively inserted.

When a general universal plug connector having only contact points with the main receptacle contacts 111 is coupled, the first stopper 133 presents the universal plug connector from being excessively inserted after deviating from a contact range with the main receptacle contacts 111. In other words, the first stopper 133 has a protrusion structure protruding at a location capable of preventing the universal plug connector coming into contact with the main receptacle contacts 111 from advancing further. At this time, the multi-type plug connector 200 preferably has an escape slot 235 which allows the first stopper 133 to escape.

When the multi plug connector 200 having contact points with the main receptacle contacts 111 and the sub receptacle contacts 112*a*, 112*b* is coupled, the second stopper 134 prevents the multi plug connector 200 from being excessively inserted after deviating from a contact range with the main receptacle contacts 111 and the sub receptacle contacts 112*a*, 112*b*.

Figure 5:
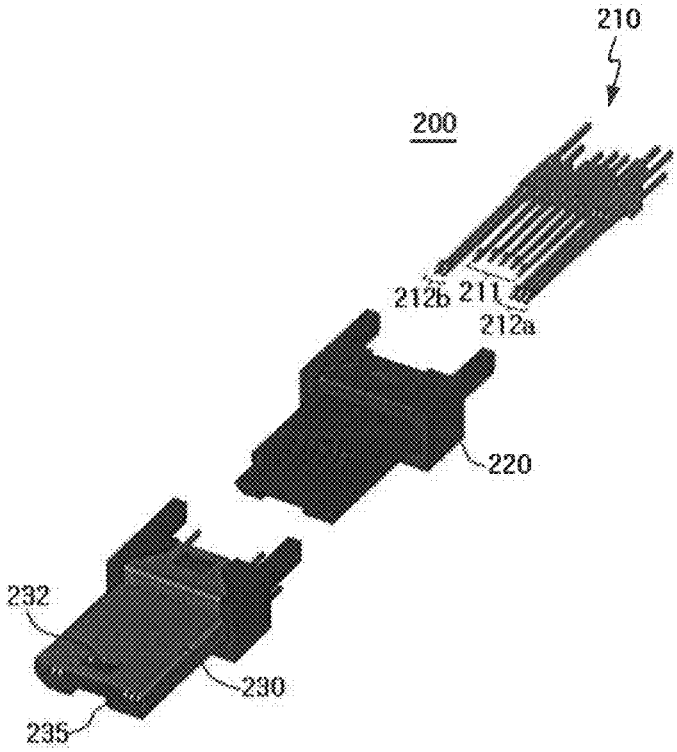
FIG. 5 is an exploded perspective view showing a multi-type plug connector according to the present disclosure.
Figure 6:
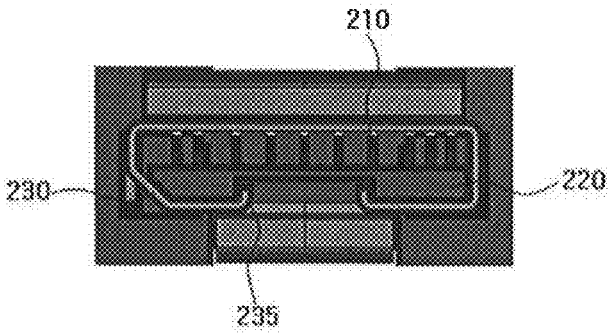
FIG. 6 is a front view showing the multi-type plug connector according to the present disclosure.
Figure 7:
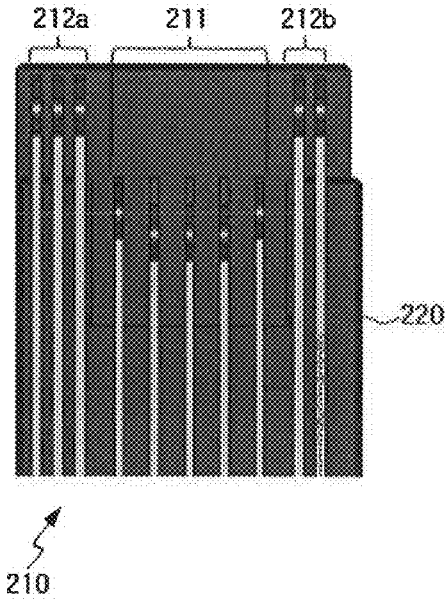
FIG. 7 is a plane view showing the multi-type plug connector according to the present disclosure.
Figure 8:
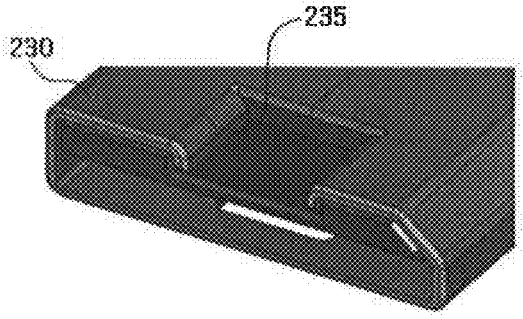
FIG. 8 is a partial perspective view showing a lower surface of the multi-type plug connector according to the present disclosure.

FIG. 5 is an exploded perspective view showing a multi-type plug connector according to the present disclosure, FIG. 6 is a front view showing the multi-type plug connector according to the present disclosure, FIG. 7 is a plane view showing the multi-type plug connector according to the present disclosure, and FIG. 8 is a partial perspective view showing a lower surface of the multi-type plug connector according to the present disclosure.

Referring to FIGS. 5 to 8, the multi-type plug connector 200 according to the present disclosure includes a plug insulator 220 having a plurality of contacts 210 arranged therein and a plug shell 230 for surrounding and shielding at least a part of the plug insulator 220.

The plurality of contacts 210 are inserted into and coupled to the plug insulator 220, and the plug insulator 220 may have a plurality of slots in which the plurality of contacts 210 may be inserted and arranged.

The plurality of contacts 210 include main plug contacts 211 arranged with pitches corresponding to the main receptacle contacts 111 of the multi-type receptacle connector 100 and sub plug contacts 212*a*, 212*b* arranged with pitches corresponding to the sub receptacle contacts 112*a*, 112*b* at each of both sides of the main plug contacts 211.

The main plug contacts 211 are arranged at the plug insulator 220 and gives connection pins corresponding to the main receptacle contacts 111 of the multi-type receptacle connector 100. For example, as shown in FIG. 7, five-pin contacts may be arranged with regular pitches to satisfy pin standards of the micro USB.

The sub plug contacts 212*a*, 212*b* gives connection pins corresponding to the sub receptacle contacts 112*a*, 112*b* of the multi-type receptacle connector 100. The sub plug contacts 212*a*, 212*b* are used to connect an additional connection module separately from the main plug contacts 211. The sub plug contacts 212*a*, 212*b* are arranged to have contact points at the same height as the main plug contacts 211 and disposed to relatively protrude forwards in comparison to the main plug contacts 2110. In other words, the sub plug contacts 212*a*, 212*b* have a relatively longer length in comparison to the main plug contacts 211. In addition, the sub plug contacts 212*a*, 212*b* may have at least one contact at each of both sides of the main plug contacts 111 so as to occupy a space of the plug insulator 220 which remains after the main plug contacts 211 are disposed. At this time, the sub plug contacts 212*a*, 212*b* may be arranged at both sides with the same number or different numbers. For example, as shown in FIG. 7, the sub plug contacts 212*a*, 212*b* may have three-pin contacts 212*a* at the left side and two-pin contacts 212*b* at the right sides, arranged with regular pitches, based on the center of the main plug contacts 211. This arrangement may be changed according to the arrangement of the corresponding sub receptacle contacts 112*a*, 112*b* of the multi-type receptacle connector 100. However, the present disclosure is not limited thereto, and various modifications can be made, as obvious to those skilled in the art.

The plug shell 230 plays a role of surrounding and shielding a part of the plug insulator 220. In addition, the plug shell 230 plays a role of helping the coupling with the receptacle connector 100 corresponding to the plug connector 200.

The plug shell 230 has a locking hole 232 used for being coupled and fixed to the receptacle connector 100 when the plug shell 230 is inserted into the receptacle connector 100. The locking hole 232 has a hole structure which may be coupled corresponding to a locking member made of an elastic piece protruding inwards at the upper portion of the receptacle connector 100 and allows the plug shell 230 to be inserted into and fixed to the receptacle connector 100. Since the multi-type plug connector 200 has a longer structure than an existing universal plug connector and the corresponding receptacle connector 100 also has a longer structure, a locking position may be located inwards so that the plug connector may be coupled and fixed to the plug connector more stably.

As shown in FIG. 6, the plug shell 230 has an escape slot 235 for escaping without being hooked to the first stopper 133 which prevents a general universal plug connector from being excessively inserted into the receptacle connector 100. By doing so, the multi-type plug connector 200 is not hooked by the first stopper 133, and all of the main plug contacts 211 and the sub plug contacts 212*a*, 212*b* may be connected to the main receptacle contacts 111 and the sub receptacle contacts 112*a*, 112*b* of the receptacle connector 100.

Figure 9:
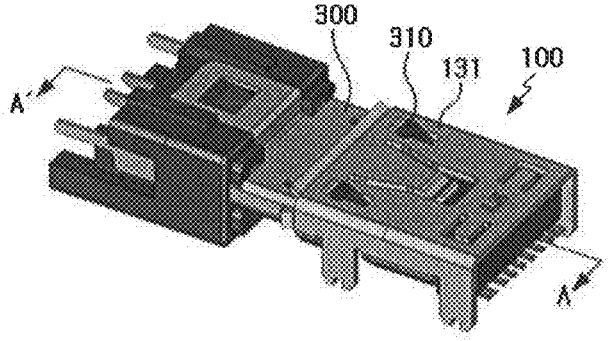
FIG. 9 is a perspective view showing a universal plug connector coupled to the multi-type receptacle connector according to the present disclosure.
Figure 10:
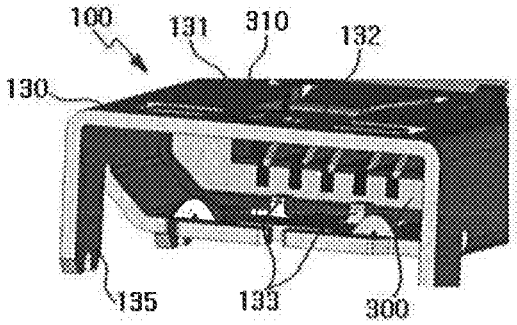
FIG. 10 is a diagram for illustrating the coupling state of FIG. 9.
Figure 11:
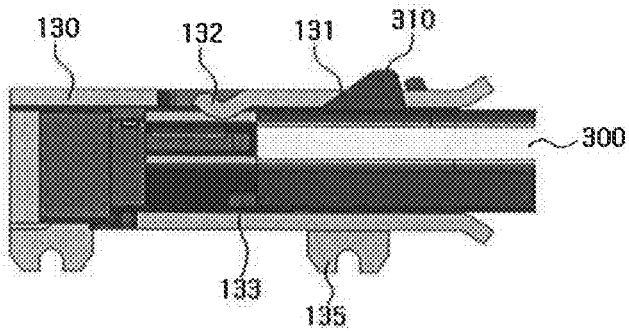
FIG. 11 is a cross-sectional view taken along the line of A-A' of FIG. 9.
Figure 12:
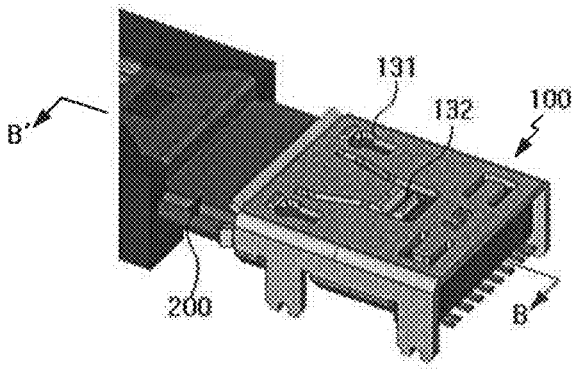
FIG. 12 is a perspective view showing a coupling state of the multi-type receptacle connector and the plug connector according to the present disclosure.
Figure 13:
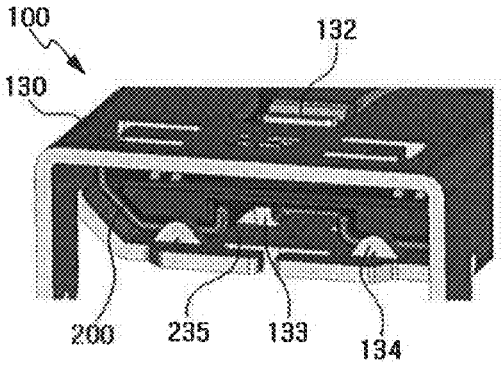
FIG. 13 is a diagram for illustrating the coupling state of FIG. 12.
Figure 14:
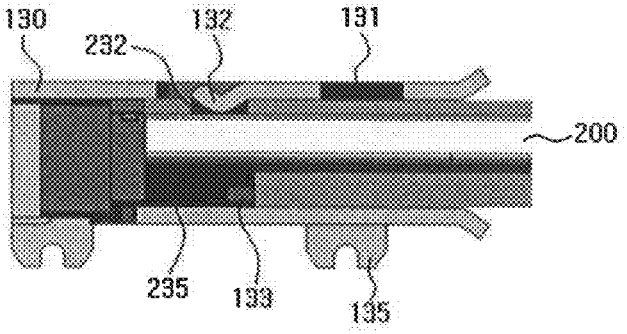
FIG. 14 is a cross-sectional view taken along the line B-B' of FIG. 12.

FIG. 9 is a perspective view showing a universal plug connector coupled to the multi-type receptacle connector according to the present disclosure, FIG. 10 is a diagram for illustrating the coupling state of FIG. 9, FIG. 11 is a cross-sectional view taken along the line of A-A' of FIG. 9, FIG. 12 is a perspective view showing a coupling state of the multi-type receptacle connector and the plug connector according to the present disclosure, FIG. 13 is a diagram for illustrating the coupling state of FIG. 12, and FIG. 14 is a cross-sectional view taken along the line B-B' of FIG. 12.

Hereinafter, a process of using the receptacle connector according to the present disclosure will be described.

First, referring to FIGS. 9 to 11, it will be described that a universal plug connector 300 is compatibly applied to the multi-type receptacle connector 100 of the present disclosure.

If the universal plug connector 300 is inserted into and coupled to the receptacle connector 100, as shown in FIGS. 9 and 11, a latch 310 of the universal plug connector 300 is coupled and fixed to the first locking member 131 of the receptacle connector 100.

In addition, as shown in FIGS. 10 and 11, the universal plug connector 300 inserted into the receptacle connector 100 is blocked by the first stopper 133 of the receptacle connector 100, thereby preventing excessive insertion at which the contact of the plug connector 300 is inserted to a location capable of coming into contact with the sub receptacle contacts 112*a*, 112*b* and thus causes inferior contact.

Moreover, referring to FIGS. 12 to 14, mutual coupling between the multi-type receptacle connector 100 according to the present disclosure and the plug connector 200 will be described.

If the plug connector 200 is inserted into and coupled to the receptacle connector 100, as shown in FIGS. 12 and 14, the second locking member 132 of the receptacle connector 100 is coupled and fixed to the locking hole 232 of the plug connector 200.

In addition, as shown in FIGS. 13 and 14, the plug connector 200 inserted into the receptacle connector 100 avoids the first stopper 133 of the receptacle connector 100 by means of the escape slot 235, is inserted into a location of the second stopper 134 and then is blocked by the second stopper 134, thereby preventing excessive insertion which causes the connector to break down.

The present disclosure has been described in detail. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

What is claimed is:

1. A multi-type receptacle connector, comprising:

a receptacle insulator;

main receptacle contacts arranged at the receptacle insulator to provide an electric contact point corresponding to a universal plug connector;

sub receptacle contacts additionally installed at both sides of the main receptacle contacts to give an additional contact point; and a receptacle shell surrounding at least a part of the receptacle insulator, wherein the sub receptacle contacts are arranged at the same height as the main receptacle contacts and disposed at a relatively inner side in the insertion direction of a plug connector in comparison to the main receptacle contacts, wherein the receptacle shell includes: a first stopper for preventing a universal plug connector having only contact points with the main receptacle contacts from being excessively inserted; and a second stopper for preventing a multi plug connector having contact points with the main receptacle contacts and sub receptacle contacts from being excessively inserted.

2. The multi-type receptacle connector according to claim 1, wherein the sub receptacle contacts have a relatively shorter length in comparison to the main receptacle contacts.

3. The multi-type receptacle connector according to claim 1, wherein the sub receptacle contacts include at least one contact at each of both sides of the main receptacle contacts, and the contacts disposed at both sides may be arranged with the same number or different numbers.

4. The multi-type receptacle connector according to claim 1, wherein the first stopper is located at a relatively front side in the inserting direction of the plug connector in comparison to the second stopper, and wherein the multi plug connector has an escaping structure for escaping from the first stopper.

5. The multi-type receptacle connector according to claim 4, wherein the receptacle shell includes: a first locking member for fixing the coupled universal plug connector; and a second locking member for fixing the coupled multi plug connector.

6. The multi-type receptacle connector according to claim 5, wherein the second locking member includes an elastic piece protruding inwards at an upper portion of the receptacle shell, and wherein a hole structure corresponding to the elastic piece is provided at an upper portion of the multi plug connector.

7. The multi-type receptacle connector according to claim 1, wherein the main receptacle contacts and the sub receptacle contacts are accommodated in the receptacle insulator in an insertion-molding fashion.

8. The multi-type receptacle connector according to claim 1, wherein the universal plug connector is a micro USB plug connector.

9. A multi-type plug connector, comprising:

main plug contacts and sub plug contacts respectively corresponding to the main receptacle contacts and the sub receptacle contact of a multi-type receptacle connector, said multi-type receptacle connector comprising a receptacle insulator; main receptacle contacts arranged at the receptacle insulator to provide an electric contact point corresponding to a universal plug connector; sub receptacle contacts additionally installed at both sides of the main receptacle contacts to give an additional contact point; and a receptacle shell surrounding at least a part of the receptacle insulator, wherein the sub receptacle contacts are arranged at the same height as the main receptacle contacts and disposed at a relatively inner side in the insertion direction of a plug connector in comparison to the main receptacle contacts;

a plug insulator for accommodating the main plug contacts and the sub plug contacts; and a plug shell surrounding at least a part of the plug insulator, wherein the sub plug contacts are arranged at the same height as the main plug contacts and disposed to protrude relatively forwards in comparison to the main plug contacts, and wherein the multi-type receptacle connector further includes a stopper for preventing a universal plug connector having only contact points with the main receptacle contacts from being excessively inserted, and wherein the plug shell has an escape slot to escape from the stopper.

10. The multi-type plug connector according to claim 9, wherein the sub plug contacts have a relatively longer length in comparison to the main plug contacts.

11. The multi-type plug connector according to claim 9, wherein the sub plug contacts include at least one contact at each of both sides of the main plug contacts, and the contacts disposed at both sides may be arranged with the same number or different numbers.

12. The multi-type plug connector according to claim 9, wherein the plug shell has a locking hole to be coupled and fixed to the multi-type receptacle connector, and wherein the multi-type receptacle connector has an elastic piece protruding inwards corresponding to the locking hole.

* * * * *